US005942472A

United States Patent [19]

Watts et al.

[11] Patent Number: 5,942,472

[45] Date of Patent: Aug. 24, 1999

[54] POWER TRANSMISSION FLUIDS OF IMPROVED VISCOMETRIC AND ANTI-SHUDDER PROPERTIES

[75] Inventors: Raymond Frederick Watts, Long Valley; David Edward Gindelberger, Bedminster; Christopher William Cornish, Cranbury, all of N.J.

[73] Assignee: Exxon Chemical Patents Inc., Linden, N.J.

[21] Appl. No.: 08/873,405

[22] Filed: Jun. 12, 1997

[51] Int. Cl.[6] ..... C10M 111/02; C10M 111/04

[52] U.S. Cl. ..... 508/291; 252/75; 252/77

[58] Field of Search ..... 508/291; 252/75, 252/77

[56] References Cited

U.S. PATENT DOCUMENTS

| | | | |
|---|---|---|---|
| 5,384,055 | 1/1995 | Ashjian | 508/291 |
| 5,395,539 | 3/1995 | Chandler et al. | 508/260 |
| 5,484,543 | 1/1996 | Chandler et al. | 508/232 |
| 5,641,732 | 6/1997 | Bloch et al. | 508/232 |
| 5,641,733 | 6/1997 | Bloch et al. | 508/232 |
| 5,750,476 | 5/1998 | Nibert et al. | 508/291 |

*Primary Examiner*—Jerry D. Johnson

[57] ABSTRACT

An improved power transmission fluid is formed which comprises a major amount of lubricating oil and an additive combination comprising (a) a viscosity modifier having a molecular weight no greater than about 175,000 atomic mass units, and (b) a selected friction modifier.

11 Claims, No Drawings

POWER TRANSMISSION FLUIDS OF IMPROVED VISCOMETRIC AND ANTI-SHUDDER PROPERTIES

BACKGROUND OF THE INVENTION

This invention relates to a composition and a method of improving the properties of power transmitting fluids, particularly to obtaining automatic transmission fluids of improved viscosity control and anti-shudder durability.

Automatic transmissions continue to become more sophisticated in design as vehicle technology advances. These design changes result from the need to improve vehicle operability, reliability, and fuel economy. Vehicle manufacturers worldwide are increasing vehicle warrantee periods and service intervals on their vehicles. This means that the automatic transmission and the automatic transmission fluid (ATF) must be designed to operate reliably without maintenance for longer periods of time. In the case of the fluid, this means longer drain intervals. To improve vehicle operability, especially at low temperature, manufacturers have imposed strict requirements for fluid viscosity at −40° C. To cope with longer drain intervals and more severe operating conditions, manufacturers have increased the requirements for oxidation resistance of the ATF and increased the amount of wear protection that the fluid must provide for the transmission. To improve the fuel economy of the vehicle and reduce energy loss in the torque converter, manufacturers employ continuously slipping torque converter clutches which require very precise control of fluid frictional properties. A common element in the quest for better reliability, longer service life, and better transmission control is the viscometric properties of the fluid.

One method of improving overall vehicle fuel economy used by transmission designers is to build into the torque converter a clutch mechanism capable of "locking" the torque converter. "Locking" refers to eliminating relative motion between the driving and driven members of the torque converter so that no energy is lost in the fluid coupling. These "locking" or "lock-up" clutches are very effective at capturing lost energy at high road speeds; however, when they are used at low speeds vehicle operation is rough and engine vibration is transmitted through the drive train. Rough operation and engine vibration are not acceptable to drivers.

The higher the percentage of time that the vehicle can be operated with the torque converter clutch engaged, the more fuel efficient the vehicle becomes. A second generation of torque converter clutches have been developed which operate in a "slipping" or "continuously sliding mode". These devices have a number of names, but are commonly referred to as continuously slipping torque converter clutches. The difference between these devices and lock-up clutches is that they allow some relative motion between the driving and driven members of the torque converter, normally at relative speeds of 10 to 100 rpm. This slow rate of slipping allows for improved vehicle performance as the slipping clutch acts as a vibration damper. Whereas the "lock-up" type clutch could only be used at road speeds above approximately 50 mph, the "slipping" type clutches can be used at speeds as low as 25 mph, thereby capturing significantly more lost energy. It is this feature that makes these devices very attractive to vehicle manufacturers.

It is well known that lowering the viscosity of an ATF at low temperatures (e.g., −40° C.) will result in improved operability of the transmission at low ambient temperatures, that increasing the amount of antiwear additives in the ATF will result in more wear protection, and that better friction control can be obtained by judicious choice of friction modifiers. However, we have now found that by proper selection of viscosity modifier molecular weight and the particular friction modifiers used, the low temperature operability, service life, and friction control of the ATF can be improved simultaneously.

Correct choice of the viscosity modifier molecular weight allows the fluid to meet the high temperature viscosity requirements imposed by the manufacturer while also allowing the fluid to meet rigorous low temperature viscosity limits. High temperature viscosity is also known to control wear in hydrodynamic and elastohydrodynamic wear regimes. High initial viscosity, at high temperatures (e.g., 100° C. and 150° C.), at both low shear (i.e., 1 to 200 $sec.^{-1}$) and high shear rates (e.g., $1\times10^6$ $sec.^{-1}$) helps to control wear in hydrodynamic lubrication situations. Equally important is the fluid's ability to maintain this viscosity under both high and low shear rates even after use. High initial viscosity at high temperatures and low shear rates is important to transmission operability. High viscosity at high temperature and low shear rate controls fluid leakage at high pressures. This is not leakage from the transmission itself, but leakage at high pressures (e.g., 830 kPa (120 psi)) around seals and valves in the transmission control system. No matter how sophisticated the electronic control of the transmission, if the fluid is leaking under pressure in the valve body, the transmission will not function properly. This is particularly important in transmissions using sliding torque converter clutches since control of these devices is accomplished via minute fluctuations in clutch actuating pressure.

We have found that by careful selection of the molecular weight of the viscosity modifier in the presence of selected friction modifiers, the aforementioned properties of the ATF can be improved simultaneously. If the molecular weight of the viscosity modifier is too low, too much viscosity modifier will be needed to produce the required viscosity at high temperatures. This is not only uneconomical but will eventually cause elevation of the viscosity at low temperature making it difficult, if not impossible, to meet lower −40° C. Brookfield viscosities. If the molecular weight of the viscosity modifier is too high, it will degrade by both mechanical shear and oxidation during service such that the high temperature viscosity contributed by the polymer will be lost, making the transmission vulnerable to wear and internal leakage. Adding sufficient high molecular weight polymer to give the required "used oil viscosity" causes elevation of the low temperature Brookfield viscosity of the fluid, possibly exceeding the specified maximum viscosity.

Since fluids exhibiting the characteristics of this invention must have exceedingly good low temperature fluidity (e.g., Brookfield viscosity $\leqq$15,000 centipoise (cP) at −40° C.), careful selection of the lubricant base oil is required. The use of certain highly refined mineral oils permits formulators to achieve the desired Brookfield viscosity without including synthetic materials. When using base oils with poorer low temperature characteristics, however, it may be necessary to use a lubricating oil that contains a synthetic base oil.

Continuously slipping torque converter clutches impose very exacting friction requirements on automatic transmission fluids used with them. The fluid must have a very good friction versus velocity relationship, i.e., friction must always increase with increasing speed. If friction decreases with increasing speed, a self-exciting vibrational state can be set up in the driveline. This phenomenon is commonly called "stick-slip" or "dynamic frictional vibration" and manifests itself as "shudder" or low speed vibration in the vehicle.

Clutch shudder is very objectionable to the driver. A fluid which allows the vehicle to operate without vibration or shudder is said to have good "anti-shudder" characteristics. Not only must the fluid have an excellent friction versus velocity relationship when it is new, but the fluid must retain those frictional characteristics over the lifetime of the fluid, which can be the lifetime of the transmission. The longevity of the anti-shudder performance in the vehicle is commonly referred to as "anti-shudder durability". It is this aspect of fluid frictional performance that this invention addresses.

It has previously been found that certain compounds made by reacting isomerized alkenyl substituted succinic anhydrides (and their saturated alkyl analogs) with polyamines, when used with overbased metallic detergents, provide a unique solution to the problem of extending anti-shudder durability (see U.S. Ser. No. 837,639 filed Apr. 21, 1997). We have now found that when these friction modifiers are used in fluids of improved viscometric properties, automatic transmission fluids of significantly improved overall performance result.

SUMMARY OF THE INVENTION

This invention relates to a power transmission fluid composition comprising a major amount of a lubricating oil and a minor amount of an additive combination comprising:

(a) a viscosity modifier having a molecular weight no greater than about 175,000 atomic mass units; and (b) a friction modifier of the following structure:

(I)

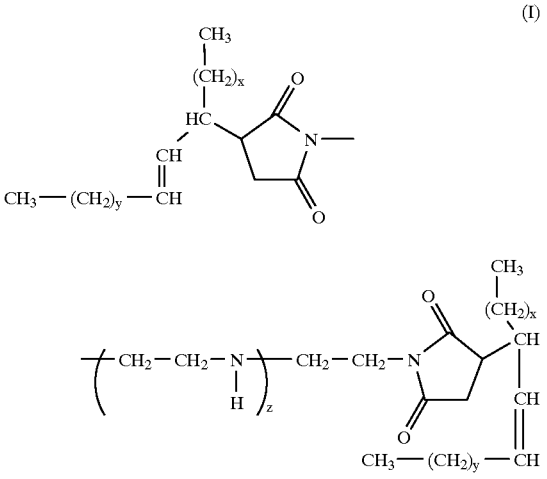

where x and y are independent integers whose sum is from 1 to 30, z is an integer from 1 to 10, and the composition has a −40° C. Brookfield viscosity no greater than 20,000 centipoise.

Another embodiment of this invention is a power transmission fluid composition comprising the product formed from the mixture of a lubricating oil and the additive combination described above. Yet another embodiment is a method for improving the low temperature operability and anti-shudder durability of a power transmission composition which comprises incorporating a minor amount of the additive combination described above into a lubricating oil.

In a particularly preferred embodiment, the composition of this invention will also include a metallic detergent.

DETAILED DESCRIPTION OF THE INVENTION

The composition of this invention requires a lubricating oil, a viscosity modifier, and a friction modifier.

(a) Lubricating Oils

Lubricating oils contemplated for use in this invention are either natural lubricating oils or derived from mixtures of natural lubricating oils and synthetic lubricating oils. Suitable lubricating oils also include basestocks obtained by isomerization of synthetic wax and slack wax, as well as basestocks produced by hydrocracking (rather than by solvent treatment) the aromatic and polar components of the crude. In general, the natural lubricating oil will have a kinematic viscosity ranging from about 1 to about 40 $mm^2/s$ (cSt) at 100° C., and the synthetic lubricating oil, if present, will have a kinematic viscosity ranging from about 1 to about 100 $mm^2/s$ (cSt) at 100° C. Typical applications will require the lubricating oil basestocks or basestock mixture to have a viscosity ranging preferably from about 1 to about 40 $mm^2/s$ (cSt), more preferably, from about 2 to about 8 $mm^2/s$ (cSt), most preferably, from about 2 to about 6 $mm^2/s$ (cSt), at 100° C.

Natural lubricating oils include animal oils, vegetable oils (e.g., castor oil and lard oil), petroleum oils, mineral oils, and oils derived from coal or shale. The preferred natural lubricating oil is mineral oil.

The mineral oils useful in this invention include all common mineral oil basestocks. This would include oils that are naphthenic or paraffinic in chemical structure as well as oils that are refined by conventional methodology using acid, alkali, and clay or other agents such as aluminum chloride, or they may be extracted oils produced, e.g., by solvent extraction or treatment with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

A particularly useful class of mineral oils are those mineral oils that are severely hydrotreated or hydrocracked. These processes expose the mineral oils to very high hydrogen pressures at elevated temperatures in the presence of hydrogenation catalysts. Typical processing conditions include hydrogen pressures of approximately 3000 pounds per square inch (psi) at temperatures ranging from 300° C. to 450° C. over a hydrogenation-type catalyst. This processing removes sulfur and nitrogen from the lubricating oil and saturates any alkylene or aromatic structures in the feedstock. The result is a base oil with extremely good oxidation resistance and viscosity index. A secondary benefit of these processes is that low molecular weight constituents of the feed stock, such as waxes, can be isomerized from linear to branched structures thereby providing finished base oils with significantly improved low temperature properties. These hydrotreated base oils may then be further de-waxed either catalytically or by conventional means to give them exceptional low temperature fluidity. Commercial examples of lubricating base oils made by one or more of the aforementioned processes are Chevron RLOP, Petro-Canada P65, Petro-Canada P100, Yukong Ltd., Yubase 4, Imperial Oil Canada MXT, and Shell XHVI 5.2.

Typically the mineral oils will have kinematic viscosities of from 2.0 $mm^2/s$ (cSt) to 10.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt), at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly(1-decenes), etc., and mixtures thereof]; alkylbenzenes [e.g., dodecylbenzenes, tetradecylbenzenes, dinonylbenzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000–1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethylhexanoic acid, and the like. A preferred type of oil from this class of synthetic oils are adipates of $C_4$ to $C_{12}$ alcohols.

Esters useful as synthetic Lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra(2-ethylhexyl) silicate, tetra(4-methyl-2-ethylhexyl) silicate, tetra(p-tert-butylphenyl) silicate, hexa(4-methyl-2-pentoxy)disiloxane, poly(methyl) siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

Typically, the lubricating oil used in this invention will be a natural lubricating oil. If a synthetic lubricating oil basestock is used, it is preferably a poly-α-olefin, monoester, diester, polyolester, or mixtures thereof. The preferred synthetic lubricating oil is a poly-α-olefin.

(b) Viscosity Modifiers

Suitable viscosity modifiers for use in this invention will have a molecular weight no greater than about 175,000, preferably no greater than about 150,000, most preferably no greater than about 140,000 atomic mass units (amu) to obtain the viscometric and shear stability (low temperature operability) benefits of this invention. Although there is no precise lower limit on the molecular weight of the viscosity modifier with which the benefits of this invention can be obtained, the molecular weight will typically range from about 20,000 to about 175,000, preferably from about 20,000 to no greater than about 150,000, and most preferably from about 30,000 to no greater than about 140,000 amu. The term "atomic mass unit" is a well-known measure of atomic mass defined as equal to 1/12 the mass of a carbon atom of mass 12.

The term "molecular weight", for the purposes of this invention, refers to the weight average molecular weight measured, e.g., by gel permeation chromatography. Also, the term molecular weight, for purposes of this invention, is intended to encompass both "actual" and "effective molecular weights". "Actual" refers to when a single viscosity modifier is used; thus, when only one viscosity modifier is employed, the molecular weight is the actual molecular weight of the viscosity modifier. The term "effective molecular weight" refers when more than one viscosity modifier is used to achieve the benefits of this invention. Effective molecular weight is calculated by summing each individual viscosity modifier's molecular weight contribution, which in turn is determined by multiplying the actual molecular weight of the individual viscosity modifier by its weight fraction in the viscosity modifier mixture.

Suitable viscosity modifiers include hydrocarbyl polymers and polyesters. Examples of suitable hydrocarbyl polymers include homopolymers and copolymers of two or more monomers of $C_2$ to $C_{30}$, e.g., $C_2$ to $C_8$ olefins, including both α-olefins and internal olefins, which may be straight or branched, aliphatic, aromatic, alkyl-aromatic, cycloaliphatic, etc. Frequently the viscosity modifiers will be copolymers of ethylene with $C_3$ to $C_{30}$ olefins, particularly preferred being the copolymers of ethylene and propylene. Other polymers can be used, such as polyisobutylenes, homopolymers and copolymers of $C_6$ and higher α-olefins, polypropylene, hydrogenated polymers and copolymers and terpolymers of styrene, e.g., with isoprene and/or butadiene.

More specifically, other hydrocarbyl polymers suitable as viscosity modifiers in this invention include those which may be described as hydrogenated or partially hydrogenated homopolymers, and random, tapered, star, or block interpolymers (including terpolymers, tetrapolymers, etc.) of conjugated dienes and/or monovinyl aromatic compounds with, optionally, α-olefins or lower alkenes, e.g., $C_3$ to $C_{18}$ α-olefins or lower alkenes. The conjugated dienes include isoprene, butadiene, 2,3-dimethylbutadiene, piperylene and/or mixtures thereof, such as isoprene and butadiene. The monovinyl aromatic compounds include vinyl di- or polyaromatic compounds, e.g., vinyl naphthalene, or mixtures of vinyl mono-, di- and/or polyaromatic compounds, but are preferably monovinyl monoaromatic compounds, such as styrene or alkylated styrenes substituted at the α-carbon atoms of the styrene, such as α-methylstyrene, or at ring carbons, such as o-, m-, p-methylstyrene, ethylstyrene, propylstyrene, isopropylstyrene, butylstyrene, isobutylstyrene, tert-butylstyrene (e.g., p-tert-butylstyrene). Also incLuded are vinylxylenes, methylethylstyrenes and ethylvinylstyrenes. The α-olefins and lower alkenes optionally included in these random, tapered and block copolymers preferably include ethylene, propylene, butene, ethylene-propylene copolymers, isobutylene, and polymers and copolymers thereof. As is also known in the art, these random, tapered, and block copolymers may include relatively small amounts, i.e., less than about 5 mol %, of other copolymerizable monomers such as vinyl pyridines, vinyl lactams, methacrylates, vinyl chloride, vinylidene chloride, vinyl acetate, vinyl stearate, and the like.

Specific examples include random polymers of butadiene and/or isoprene and polymers of isoprene and/or butadiene and styrene. Typical block copolymers include polystyrene-polyisoprene, polystyrene-polybutadiene, polystyrene-polyethylene, polystyrene-ethylene propylene copolymer, polyvinyl cyclohexane-hydrogenated polyisoprene, and polyvinyl cyclohexane-hydrogenated polybutadiene. Tapered polymers include those of the foregoing monomers prepared by methods known in the art. Star-shaped polymers typically comprise a nucleus and polymeric arms linked to the nucleus, the arms being comprised of homopolymer or interpolymer of the conjugated diene and/or monovinyl aromatic monomers. Typically, at least about 80% of the aliphatic unsaturation and about 20% of the aromatic unsaturation of the star-shaped polymer is reduced by hydrogenation.

Representative examples of patents which disclose such hydrogenated polymers or interpolymers include U.S. Pat. Nos. 3,312,621; 3,318,813; 3,630,905; 3,668,125; 3,763,044; 3,795,615; 3,835,053; 3,838,049; 3,965,019; 4,358,565; and 4,557,849.

Suitable hydrocarbyl polymers are ethylene copolymers containing from 15 to 90 wt. % ethylene, preferably 30 to 80 wt. % of ethylene, most preferably 40 to 70 wt. % of ethylene, and 10 to 85 wt. %, preferably 20 to 70 wt. %, most preferably 30 to 60 wt. %, of one or more $C_3$ to $C_{28}$, preferably $C_3$ to $C_{18}$, most preferably $C_3$ to $C_8$, α-olefins. While not essential, such copolymers preferably have a degree of crystallinity of less than 25 wt. %, as determined by X-ray and differential scanning calorimetry. Copolymers of ethylene and propylene are most preferred. Other α-olefins suitable in place of propylene to form the copolymer, or to be used in combination with ethylene and propylene, to form a terpolymer, tetrapolymer, etc., includes 1-butene, 1-pentene, 1-hexene, 1-heptene, 1-octene 1-nonene, 1-decene, etc.; also branched chain α-olefins, such as 4-methylpent-1-ene, 4-methylhex-1-ene, 5-methylpent-1-ene, 4,4-dimethylpent-1-ene, and 6-methylhept-1-ene, etc., and mixtures thereof.

Terpolymers, tetrapolymers, (etc., of ethylene, the $C_3$ to $C_{28}$ α-olefin, and non-conjugated diolefin or mixtures of such diolefins may also be used. The amount of the non-conjugated diolefin generally ranges from about 0.5 to 20 mol %, preferably from about 1 to about 7 mol %, most preferably from about 2 to about 6 mol %, based on the total amount of ethylene and α-olefin present.

The preferred viscosity modifiers are polyesters, most preferably polyesters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or monocarboxylic acids, preferably saturated, such as vinyl acetate, vinyl laurate, vinyl palmitate, vinyl stearate, vinyl oleate, and the like and mixtures thereof. Copolymers of vinyl alcohol esters with unsaturated acid esters such as copolymers of vinyl acetate with dialkyl fumarates, can also be used.

The esters may be copolymerized with still other unsaturated monomers such as olefins, e.g., 0.2 to 5 mol of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, see, e.g. U.S. Pat. No. 3,702,300.

Such ester polymers may be grafted with, or the ester copolymerized with, polymerizable unsaturated nitrogen-containing monomers to impart dispersancy to the viscosity modifiers. Examples of suitable unsaturated nitrogen-containing monomers to impart dispersancy include those containing 4 to 20 carbon atoms such as amino substituted olefins as p-(β-diethylaminoethyl)styrene; basic nitrogen-containing heterocycles carrying a polymerizable ethylenically unsaturated substituent, e.g., vinyl pyridines and vinyl alkyl pyridines such as 2-vinyl-5-ethylpyridine, 2-methyl-5-vinylpyridine, 2-vinylpyridine, 3-vinylpyridine, 4-vinylpyridine, 3-methyl-5-vinylpyridine, 4-methyl-2-vinylpyridine, 4-ethyl-2-vinylpyridine, 2-butyl-5-vinylpyridine, and the like. N-vinyl lactams are also suitable, e.g., N-vinyl pyrrolidones or N-vinyl piperidones.

The vinyl pyrrolidones are preferred and are exemplified by N-vinylpyrrolidone, N-(1-methylvinyl)pyrrolidone, N-vinyl-5-methylpyrrolidone, N-vinyl-3,3-dimethylpyrrolidone, N-vinyl-5-ethylpyrrolidone, etc.

A second method for adding dispersancy to the polyester polymers is through the carboxylic acid moiety on the backbone. This can be achieved by forming esters or amides with certain nitrogen containing alcohols and amines. Examples of chemicals useful for forming such dispersive polymers are 3-(N,N-dimethylamino)propylamine, 3-(N,N-dimethylamino)propanol, N-(3-aminopropyl)morpholine, N-(3-hydroxypropyl)morpholine, triethylenetetramine, and tetraethylenepentamine. The ester or amide linkage can be formed either prior to, or subsequent to, polymerization of the unsaturated acid or ester. This can be done easily by transesterification or transamidation. The preferred materials are those containing the 3-(N,N-dimethylpropyl) moiety.

The amount of viscosity modifier used can vary broadly and is not critical to the practice of this invention. This amount need only be that effective to modify the viscosity of the composition. Typically, however, the viscosity modifier will be present in the finished composition in an amount between 3 and 15 wt. %, preferably between 4 and 10 wt. %, especially when the viscosity modifier is a polymethacrylate, the preferred viscosity modifier.

(c) Friction Modifiers

The starting components for forming the structure (I) compounds are isomerized alkenyl succinic anhydrides which are prepared from maleic anhydride and internal olefins i.e., olefins which are not terminally unsaturated and therefore do not contain the

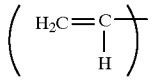

moiety. These internal olefins can be introduced into the reaction mixture as such, or they can be produced in situ by exposing α-olefins to isomerization catalysts at high temperatures. A process for producing such materials is described in U.S. Pat. No. 3,382,172. The isomerized alkenyl substituted succinic anhydrides have the structure shown as structure (II), where structure (II) is represented by:

(II)

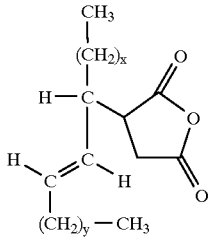

where x and y are independent integers whose sum is from 1 to 30.

The preferred succinic anhydrides are produced from isomerization of linear α-olefins with an acidic catalyst followed by reaction with maleic anhydride. The preferred α-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The isomerized alkenyl succinic anhydrides are then further reacted with polyamines of structure (III), where structure (III) is represented by:

(III)

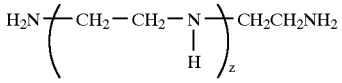

where z is an integer from 1 to 10, preferably from 1 to 3.

These are common polyethylene amines. When z=1 the material is diethylene triamine, when z=2 the material is triethylene tetramine, when z=3 the material is tetraethylene pentamine, for products where z>3 the products are commonly referred to as "polyamine" or PAM. The preferred products of this invention employ diethylene triamine, triethylene tetramine, tetraethylene pentamine or mixtures thereof.

The isomerized alkenyl succinic anhydrides (II) are typically reacted with the amines in a 2:1 molar ratio so that both primary amines are predominantly converted to succinimide. Sometimes a slight excess of isomerized alkenyl succinic anhydride (II) is used to insure that all primary amines have reacted. The products of the reaction are shown as structure (I).

The disuccinimides of structure (I) may be further post-treated by any number of techniques known in the art. These techniques include, but are not limited to, boration, maleation, acid treating with inorganic acids such as phosphoric acid, phosphorous acid, and sulfuric acid. Descriptions of these processes can be found in, e.g., U.S. Pat. Nos. 3,254,025; 3,502,677; 4,686,054; and 4,857,214.

Another useful derivative of the friction modifiers are where the isomerized alkenyl groups of structures (I) and (II) have been hydrogenated to form their saturated alkyl analogs. These saturated versions of structures (I) and (II) may likewise be post-treated as previously described.

The amount of friction modifier used in this invention can vary broadly and is not critical to this invention. The amount used need only be that effective to modify the friction characteristics of the composition. Typically this amount will range from 0.01 to 10 wt. %, preferably from 2 to 7 wt. %, and most preferably from 3 to 6 wt. % of the finished fluid.

Examples for producing the structure (I) compounds of the present invention are given below. These examples are intended for illustration and the invention is not limited to the specific details set forth.

PREPARATIVE EXAMPLES

Example FM-1

Into a one liter round bottomed flask fitted with a mechanical stirrer, nitrogen sweep, Dean Starke trap and condenser was placed 352 g (1.00 mol) of iso-octadecenylsuccinic anhydride (ODSA from Dixie Chemical Co.). A slow nitrogen sweep was begun, the stirrer started and the material heated to 130° C. Commercial tetraethylenepentamine, 87 g (0.46 mol), was immediately added slowly through a dip tube to the hot stirred iso-octadecenylsuccinic anhydride. The temperature of the mixture increased to 150° C. and was held there for two hours. During this heating period, 8 mL of water (~50% of theoretical yield) were collected in the Dean Starke trap. The flask was cooled to yield the product. Yield: 427 g; percent nitrogen: 7.2.

Example FM-2

The procedure of Example FM-1 was repeated except that the following materials and amounts were used: iso-octadecenylsuccinic anhydride, 458 g (1.3 mol), and diethylenetriamine, 61.5 g (0.6 mol). The water recovered was 11 mL. Yield: 505 g; percent nitrogen: 4.97.

Example FM-3

The procedure of Example FM-1 was repeated except that the following materials and amounts were used: iso-hexadecenylsuccinic anhydride (ASA-100 from Dixie Chemical Co.), 324 g (1.0 mol), and tetraethylenepentamine, 87 g, 0.46 mol). The water recovered was 9 mL. Yield: 398 g; percent nitrogen: 8.1.

Example FM-4

The product of Example FM-1, 925 g (1.0 mol), and 300 g of a naphthenic base oil (Necton-37 from Exxon Chemical Co.) were placed in a 2 liter flask fitted with a heating mantle, an overhead stirrer, nitrogen sweep, and condenser. The temperature of the mixture was raised to 80° C., the stirrer started and a nitrogen sweep begun. To this hot solution maleic anhydride, 98 g (1.0 mol), was added slowly over about 20 minutes. Once the addition was complete, the temperature was raised to 150° C. and held there for 3 hours. The product was cooled and filtered. Yield: 1315 g; percent nitrogen: 5.2.

Example FM-5

The product of Example FM-1, 925 g (1.0 mol), and 140 g of a naphthenic base oil (Necton-37 from Exxon Chemical Co.) and 1 g of DC-200 anti-foamant were placed in a 2 liter round bottomed flask fitted with a heating mantle, an overhead stirrer, nitrogen sweep, Dean Starke trap, and condenser. The solution was heated to 80° C. and 62 g (1.0 mol) of boric acid was added. The mixture was heated to 140° C. and held there for 3 hours. During this heating period, 3 mL of water were collected in the Dean Starke trap. The product was cooled and filtered. Yield: 1120 g; percent nitrogen: 6.1; percent boron: 0.9.

(d) Metallic Detergents

Best results are obtained when the composition also contains a metallic detergent. The metal-containing detergents of the compositions of this invention are exemplified by oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkylphenols, (6) organic phosphorus acids characterized by at least one direct carbon-to-phosphorus linkage. Such organic phosphorus acids include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium and magnesium. The preferred salts useful with this invention are either neutral or overbased salts of calcium or magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl β-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-ccntaining detergents include, but are not limited to, neutral and overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or over-based salts of two or more different alkali and/or alkaline earth metals can be used. Likewise, neutral and/or overbased salts of mixtures of two or more different acids (e.g., one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil-soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, have sometimes been simply called neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See, e.g., U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; and 4,380,550.

The metallic detergents utilized in this invention can, if desired, be oil-soluble boronated neutral and/or overbased alkali of alkaline earth metal-containing detergents. Methods for preparing boronated metallic detergents are described in, e.g., U.S. Pat. Nos. 3,480,548; 3,679,584; 3,829,381; 3,909,691; 4,965,003; and 4,965,004.

Preferred metallic detergents for use with this invention are overbased sulfurized calcium phenates, overbased calcium sulfonates, and overbased magnesium sulfonates.

The amount of metallic detergent used can vary broadly and is not critical to the practice of this invention. This amount need only be that effective to modify the detergency of the composition. Typically, however, this amount will range from 0.01 to 2.0 wt. %, preferably from 0.05 to 1.0 wt. %, and most preferably from 0.05 to 0.5 wt. % in the finished fluid.

Other additives known in the art may be added to the ATF. These additives include dispersants, antiwear agents, antioxidants, corrosion inhibitors, detergents, extreme pressure additives, and the like. They are generally disclosed in, e.g., "Lubricant Additives" by C. V. Smalheer and R. Kennedy Smith, 1967, pp. 1–11 and U.S. Pat. Nos. 5,389,273; 5,326,487; 5,314,633; 5,256,324; 5,242,612; 5,198,133; 5,185,090; 5,164,103; 4,855,074; and 4,105,571.

Representative amounts of these additives are summarized as follows:

| Additive | Broad (wt. %) | Preferred (wt. %) |
|---|---|---|
| Corrosion Inhibitor | 0.01–3 | 0.02–1 |
| Antioxidants | 0.01–5 | 0.2–3 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Seal Swellants | 0.1–8 | 0.5–5 |

Suitable dispersants include hydrocarbyl succinimide, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimide. These include acyclic hydrocarbyl substituted succinimide formed with various amines or amine derivatives such as are widely disclosed in the patent literature. Use of alkenyl succinimide which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000, preferably 800 to 2500, most preferably 1000 to 2000, are particularly suitable. Dispersants may be post-treated with many reagents known to those skilled in the art (see for example U.S. Pat. Nos. 3,254,025; 3,502,677; and 4,857,214).

Suitable antioxidants are amine-type and phenolic antioxidants. Examples of the amine-type antioxidants include phenyl-α-naphthylamine, phenyl-β-naphthylamine, diphenylamine, bis-alkylated diphenyl amines (e.g., p,p'-bis (alkylphenyl)amines wherein the alkyl groups contain from 8 to 12 carbon atoms each). Phenolic antioxidants include sterically hindered phenols (e.g., 2,6-di-tert-butylphenol, 4-methyl-2,6-di-tert-butylphenol, etc.) and bis-phenols (e.g., 4,4'-methylenebis(2,6-di-tert-butylphenol), etc.) and the like.

Additive concentrates of this invention will contain the viscosity modifier, friction modifier, and other desired additives in a natural and/or synthetic lubricating oil, in relative proportions such that by adding the concentrate to a larger amount of a suitable natural and/or synthetic oil the resulting fluid will contain each of the ingredients in the desired concentration. Thus, the concentrate may contain a synthetic oil as the lubricating oil if the desired final composition contains a lesser amount of synthetic oil relative to the mineral oil. The concentrate typically will contain between 25 wt. % to 100 wt. %, preferably from 65 wt. % to 95 wt. %, most preferably from 75 wt. % to 90 wt. % of the viscosity modifier, friction modifier, other desired additives, and synthetic and/or natural oil.

Viscometric Properties

The viscometric properties of lubricating fluids are commonly measured under a variety of conditions similar to the conditions of their use to characterize their performance. Generally the viscosity of the lubricating fluids are measured at a high shear rate (e.g., $1\times10^6$ sec.$^{-1}$) and a low shear rate (e.g., 0 to $2\times10^2$ sec.$^{-1}$) in both a "new", i.e., fresh or unused condition, and a used, i.e., sheared, condition. The used fluid is produced by passing the new fluid through a fuel injector a specified number of times, in the cases reported in Table 1, 40 times.

Since improved operation of vehicles at low ambient temperatures is an objective, it is desirable that the Brookfield viscosity at −40° C. not be greater than 15,000 cP for all embodiments of this invention.

The following examples should be understood to illustrate the invention and should not be interpreted to limit its scope.

EXAMPLES

No standardized test exists for evaluating anti-shudder durability of automatic transmission fluids. Several test methods have been discussed in published literature. The methods all share a common theme, i.e., continuously sliding a friction disk immersed in a test fluid at a certain set of conditions. At preset intervals, the friction versus velocity characteristics of the fluid are determined. The common failing criteria for these tests is when dMu/dV (the change in friction coefficient with velocity) becomes negative, i.e., when increasing velocity results in lower friction coefficient. A similar method which is described below, has been used to evaluate the compositions of this invention.

Anti-Shudder Durability Test Method

An SAE No. 2 test machine fitted with a standard test head was modified to allow test fluid to be circulated from an external constant temperature reservoir to the test head and back. The test head is prepared by inserting a friction disk and two steel separator plates representative of the sliding torque converter clutch (this assembly is referred to as the clutch pack). Two liters of test fluid are placed in the heated bath along with a 32 cm$^2$ (5 in.$^2$) copper coupon. A small pump circulates the test fluid from the reservoir to the test head in a loop. The fluid in the reservoir is heated to 145° C. while being circulated through the test head, and 50 ml/min. of air are supplied to the test head. The SAE No. 2 machine drive system is started and the test plate rotated at 180 rpm, with no apply pressure on the clutch pack. This break-in period is continued for one hour. At the end of one hour five (5) friction coefficient (Mu) versus velocity measurements are made. Then 6 dynamic engagements of 13,500 joules each are run, followed by one measurement of static breakaway friction. Once this data collection is accomplished, a durability cycle is begun.

The durability cycle is run in approximately one hour segments. Each hour the system is "slipped" at 155° C., 180 rpm, and 10 kg/cm$^2$ for 50 minutes. At the end of the 50 minutes of slipping, twenty (20) 13,500 joule dynamic engagements are run. This procedure is repeated three more times, giving a four hour durability cycle. At the end of four hours, 5 Mu versus velocity measurements are made at 120° C. The dMu/dV for the fluid is calculated by averaging the 3rd, 4th, and 5th Mu versus velocity measurements and calculating dMu/dV by subtracting the Mu value at 0.35 m/s from the Mu value at 1.2 m/s and dividing by the speed difference, 0.85 m/s. For convenience, the number is multiplied by 1000 to convert it to a whole number. A fluid is considered to have lost anti-shudder protection when the dMu/dV reaches a value of negative three (−3). The result is reported as "Hours to Fail". Several commercial ATF's which do not possess anti-shudder durability characteristics have been evaluated by this test method. They give "Hours to Fail" in the range of 15 to 25.

Five ATF fluid formulations were blended to meet the required viscometric properties described above. Fluid Formulations 1 through 5 used the same basic additive package which contains ashless dispersant, anti-oxidant, extreme pressure agent, corrosion inhibitor and friction modifiers. The composition of these Fluid Formulations are shown in Table 1, along with relevant test results. Fluid Formulations 1 through 4 meet the requirements of the current invention. They contain the friction modifier of Example FM-1, as described in the Preparative Examples above. Fluid Formulation 5 meets all of the criteria of the invention except that it does not contain the friction modifier of Example FM-1 and Fluid Formulation 5 is included only as a comparative example.

The results shown in Table 1 indicate that Fluid Formulation 1 through 5 using viscosity modifiers of an appropriate molecular weight (less than about 175,000 amu) have superior and desirable viscometric parameters either new or used, i.e., the viscosity is always greater than 2.6 cP at 150° C. when measured at shear rates 2× of $10^2$ and $10^6$ sec.$^{-1}$, and always have kinematic viscosities (as measured by ASTM D 445) greater than 6.8 mm$^2$/sec. In addition, the fluids containing a friction modifier of the present invention plus a metallic detergent, i.e., Fluid Formulations 1 through 4, have significantly better anti-shudder durability than the comparative example, Fluid Formulation 5, which does not contain these materials. It is therefore clear from the data in Table 1 that the compositions of the present invention provide fluids of both improved viscometric properties and significantly better anti-shudder durability.

The principles, preferred embodiments, and modes of operation of the present invention have been described in the foregoing specification. The invention which is intended to be protected herein, however, is not to be construed as limited to the particular forms disclosed, since these are to be regarded as merely illustrative. Variations and changes may be made by those skilled in the art without departing from the spirit of the invention and are intended to be embraced in the accompanying claims.

TABLE 1

| | Test Results | | | | |
|---|---|---|---|---|---|
| FLUID FORMULATON | 1 | 2 | 3 | 4 | 5 |
| Base Additive Package | 8.00 | 8.00 | 8.00 | 8.00 | 8.00 |
| Product of Example FM-1 | 2.50 | 2.50 | 2.50 | 2.50 | — |
| Metallic Detergent, Ca Sulfonate* | 0.10 | 0.10 | 0.10 | 0.10 | — |
| Viscoplex 5061 (MW 140,000) | 4.00 | 4.89 | 4.80 | 4.44 | 4.00 |
| Viscoplex 8-220 (MW 75,000) | 5.00 | 6.11 | 6.00 | 5.56 | 5.00 |
| Exxon Solvent 75 Neutral | 24.00 | 24.25 | — | — | 26.5 |
| Exxon Solvent 100 Neutral | 26.50 | 24.25 | — | — | 26.50 |
| Imperial Oil MXT-5 | — | — | 51.20 | — | — |
| Petro-Canada 65P | — | 30.00 | 30.00 | 30.00 | — |
| Petro-Canada 100P | — | — | — | 52.00 | — |
| PAO-4 | 30.00 | — | — | — | 30.00 |
| TEST RESULTS | | | | | |
| New Fluid | | | | | |
| Kinematic Viscosity @ 100° C.; mm$^2$/sec | 7.95 | 7.90 | 7.90 | 8.00 | 7.95 |
| Brookfield Viscosity @ −40° C., cP | 11,500 | 12,400 | 11,400 | 9,680 | 11,100 |
| Viscosity @ 150° C., 2 × $10^2$ sec$^{-1}$, cP | 2.95 | 2.96 | 2.96 | 3.00 | 2.91 |
| Viscosity @ 150° C., 1 × $10^6$ sec$^{-1}$, cP | 2.71 | 2.83 | 2.79 | 2.76 | 2.73 |
| Used Fluid | | | | | |
| Kinematic Viscosity @ 100° C., mm$^2$/sec | 7.41 | 7.40 | 7.50 | 7.46 | 7.42 |
| Viscosity @ 150° C., 2 × $10^2$ sec$^{-1}$, cP | 2.72 | 2.76 | 2.73 | 2.82 | 2.74 |
| Viscosity @ 150° C., 1 × $10^6$ sec$^{-1}$, cP | 2.69 | 2.72 | 2.73 | 2.69 | 2.69 |
| Anti-Shudder Durability | | | | | |
| Hours to Fail | 250 | N/R | 220 | 270 | 55 |

*Parabar 9330, available from EXXON Chemical Co.

What is claimed is:

1. A power transmission fluid composition comprising a major amount of a lubricating oil and a minor amount of an additive combination comprising:

(a) 4–15 wt. % of a polymethacrylate viscosity modifier having a molecular weight no greater than about 175,000 atomic mass units; and (b) a friction modifier having the structure:

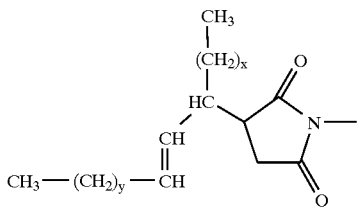

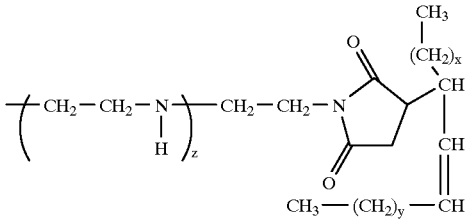

where x and y are independent integers whose sum is from 1 to 30, z is an integer from 1 to 10, and the composition has a −40° C. Brookfield viscosity no greater than 20,000 centipoise.

2. The composition of claim 1, where the lubricating oil is a mixture of mineral oil and poly-α-olefin.

3. The composition of claim 1, wherein the friction modifier is characterized by having the sum of x and y equal to 13 and z equals 1.

4. The composition of claim 3, further comprising:

a borated or non-borated succinimide dispersant; and a phenolic or amine antioxidant, such that the amount of the dispersant, antioxidant, and friction modifier is between 2.0 to 11 weight percent of the composition.

5. The composition of claim 1, where the composition has new and sheared kinematic viscosities of at least 6.8 $mm^2/s$ at 100° C.

6. The composition of claim 5, wherein the composition has new and sheared kinematic viscosities of at least 6.8 $mm^2/s$ at 100° C. and at least 2.6 cP at 150° C. for shearing rates up to $1\times10^6$ $sec.^{-1}$.

7. The composition of claim 6, wherein the composition has new and sheared viscosities of at least 6.8 $mm^2/s$ at 100° C. and at least 2.6 cP at 150° C. for shearing rates up to $1\times10^6$ $sec.^{-1}$ after shearing.

8. The composition of claim 1, wherein the lubricating oil has a kinematic viscosity of from about 2 $mm^2/s$ to about 8 $mm^2/s$ at 100° C.

9. The composition of claim 1, wherein the viscosity modifier has a molecular weight from about 20,000 to 175,000 atomic mass units.

10. The composition of claim 1, further comprising a metallic detergent.

11. The composition of claim 10, wherein the metallic detergent is selected from the group consisting of overbased sulfurized calcium phenates, overbased calcium sulfonates, and overbased magnesium sulfonates.

* * * * *